US005870910A

United States Patent [19]

Specht

[11] Patent Number: 5,870,910

[45] Date of Patent: Feb. 16, 1999

[54] LOCK-DOWN SECURITY BOX

[75] Inventor: Paul E. Specht, Glenview, Ill.

[73] Assignee: Block and Company, Inc., Wheeling, Ill.

[21] Appl. No.: 759,267

[22] Filed: Dec. 2, 1996

[51] Int. Cl.[6] ..... E05B 65/52

[52] U.S. Cl. ..... 70/58; 70/63; 70/161; 70/DIG. 57; 70/DIG. 63; 109/52; 248/225.11; 248/553; 312/333

[58] Field of Search ..... 70/63, 159–162, 70/DIG. 57, DIG. 63, 58; 107/47, 50–52; 232/1 D, 15, 43.2, 7, 12, 16; 248/225.11, 551, 552, 553; 312/333, 334.27

[56] References Cited

U.S. PATENT DOCUMENTS

| | | | |
|---|---|---|---|
| 1,082,790 | 12/1913 | Beshore . | |
| 1,203,282 | 10/1916 | Uth . | |
| 1,647,275 | 11/1927 | Cursons | 232/1 D |
| 1,869,302 | 7/1932 | Brosnan . | |
| 2,026,977 | 1/1936 | Jaeger | 109/3 |
| 2,410,475 | 11/1946 | Anderson | 109/52 |
| 3,333,764 | 8/1967 | Pennell | 232/15 |
| 3,741,132 | 6/1973 | Blower | 109/52 |
| 3,822,049 | 7/1974 | Saunders | 70/258 X |
| 3,948,376 | 4/1976 | Roman | 232/15 X |
| 4,043,279 | 8/1977 | Padgett | 109/50 |
| 4,098,199 | 7/1978 | Haje | 109/52 |
| 4,186,977 | 2/1980 | Gilovich et al. | 312/215 |
| 4,244,304 | 1/1981 | Read | 109/52 |
| 4,249,684 | 2/1981 | Miller et al. | 224/42.4 |
| 4,258,632 | 3/1981 | LaPointe | 109/59 R |
| 4,266,703 | 5/1981 | Litz | 248/553 X |
| 4,398,470 | 8/1983 | Williams et al. | 109/52 |
| 4,493,268 | 1/1985 | Sidler | 109/52 |
| 4,577,563 | 3/1986 | Sidler | 109/52 |
| 4,616,776 | 10/1986 | Blumenthal et al. | 109/52 X |
| 4,638,746 | 1/1987 | Ishigure | 109/52 |
| 4,951,577 | 8/1990 | Bentley | 109/51 |
| 5,353,904 | 10/1994 | Tacke et al. | 248/553 X |
| 5,488,914 | 2/1996 | Ouellette | 109/56 |
| 5,607,102 | 3/1997 | Walsh et al. | 109/52 X |

FOREIGN PATENT DOCUMENTS

| | | | |
|---|---|---|---|
| 66324 | 12/1982 | European Pat. Off. | 109/52 |
| 1017185 | 12/1952 | France | 109/52 |
| 3532804 | 3/1987 | Germany | 232/15 |
| 2103281 | 2/1983 | United Kingdom | 232/43.2 |

*Primary Examiner*—Lloyd A. Gall
*Attorney, Agent, or Firm*—Lockwood, Alex, FitzGibbon & Cummings

[57] ABSTRACT

A lock-down security box including a security box and a lock-down plate. The lock-down security box is adapted to be detachably anchored to a mounting surface such as a table, wall or the like. The lock-down plate is fixed to a mounting surface by inserting fasteners through apertures extending through the plate. The lock-down plate includes a first anchoring member and a bolt-receiving slot extending therethrough. The security box includes a top panel which is pivotally mounted to one of the side panels of the box. The top panel includes a first lock set associated therewith for providing controlled access to the enclosure of the security box. The bottom panel of the security box includes a second anchoring member mounted thereon. The bottom panel further includes a bolt-passage slot extending therethrough which is adapted to receive a deadbolt of a second lock set mounted to one of the side panels of the box. When the first anchoring member of the lock-down plate and the second anchoring member mounted on the bottom panel of the security box are operatively associated with each other, the bolt-receiving slot and the bolt-passage slot are in registration which each other, thereby allowing the deadbolt portion of the second lock set to extend through those slots.

18 Claims, 4 Drawing Sheets

LOCK-DOWN SECURITY BOX

BACKGROUND AND DESCRIPTION OF THE INVENTION

The present invention generally relates to portable security boxes which may be selectively anchored to a location of use to prevent unauthorized removal thereof and, more particularly, is directed to a lock-down security box that includes a security box that can be received on and lockingly secured to a lock-down plate that, in turn, is fixed to a table, wall or other suitable mounting surface which security box, by activation of a lock mechanism, can be removed from the lock-down plate and transported to another location.

Security boxes having compartments for receiving and holding paper currency, coins and/or negotiable instruments are known in the prior art. Also, it is known to provide various systems for mounting these prior art security boxes to flat planar surfaces. These prior art security boxes, although useful for limited applications, do not achieve the benefits and advantages derived from the present invention.

One disadvantage of these prior art security boxes is that they do not permit the security box to be selectively secured to any of a plurality of like lock-down members at different locations. Also, these prior art arrangements typically include only a single lock set to provide both controlled access to the enclosure of the security box and to anchor the box to the lock-down member. As such, these single lock set arrangements typically utilize complex dual acting locking mechanisms which are relatively complex and costly to manufacture.

The present invention overcomes the problems and disadvantages by these prior art security box/anchoring member systems by providing an improved lock-down security box which includes a security box and a lock-down plate which can be fixed to a mounting surface. This lock-down plate includes a first anchoring member.

The security box includes a plurality of enclosure-defining panels. At least one of the panels is movable between an open and a closed position to permit access to the enclosure of the security box. The movable panel includes a first lock set associated therewith for selectively locking that panel. Thus, the first lock set provides controlled access to the enclosure of the security box.

The security box further includes a second anchoring member mounted to the exterior face of one of the panels. A second lock set mounted to one of the panels of the box independently enables the security box to be detachably anchored to the lock-down plate when the first anchoring member of the lock-down plate and the second anchoring member of the security box are operatively associated with each other.

It is, therefore, an object of the present invention is to provide a new and improved lock-down security box.

Another object of the present invention is to provide a security box that can be lockingly anchored to and removed from any of a plurality of locations.

Another object of the present invention is to provide a new and improved lock-down security box that includes a pair of lock sets, one of which is used to provide controlled access to the enclosure of the box and the other of which is used to secure the security box to a lock-down plate.

Another object of the present invention is to provide a new and improved lock-down security box that may be easily and economically manufactured.

These and other objects of the present invention will be apparent from the following detailed description taken in conjunction with the accompanying drawings wherein like reference numerals identify like parts, and in which.

Figure 1:
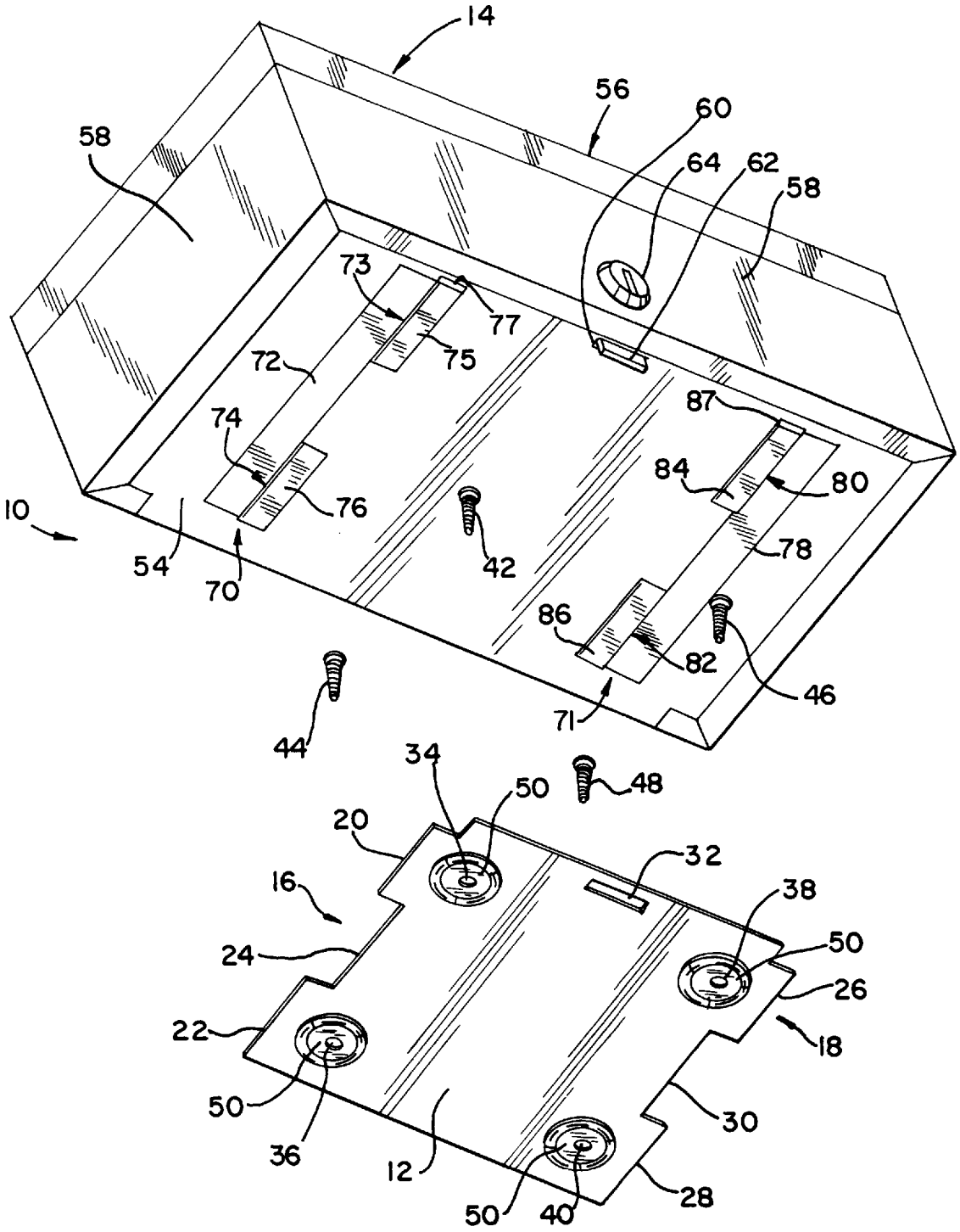
FIG. 1 is an exploded bottom isometric view of the improved lock-down security box constructed in accordance with the present invention.

Referring to the drawings, and particularly to FIG. 1, a lock-down security box constructed in accordance with the present invention is generally depicted by the reference number 10. As shown, lock-down security box 10 includes a lock-down plate 12 and a security box 14.

In a preferred embodiment of the invention, lock-down plate 12 is generally flat as shown in FIG. 1. The lock-down plate includes a first anchoring member which is shown, for illustrative purposes only, as a pair of opposed marginal edge portions 16 and 18 of the lock-down plate. As shown, marginal edge portion 16 may comprise two outwardly-extending flange portions 20 and 22 and a recessed portion 24. Likewise, marginal edge portion 18 may include two outwardly-extending flange portions 26 and 28 and a recessed portion 30.

The generally flat lock-down plate 12 further includes a bolt-receiving slot 32 which extends through the lock-down plate. As will become apparent during a discussion of the operational characteristics of the lock-down security box 10, the bolt-receiving slot 32 is preferably adapted to receive a standard deadbolt.

The lock-down plate further includes a plurality of apertures identified by reference numerals 34, 36, 38 and 40 which enable the lock-down plate to be fixed to a mounting surface 41 (see FIG. 5) such as a table or a wall, for example. To fix lock-down plate 12 to such a mounting surface, the plurality of fasteners, which are shown for illustrative purposes only as a plurality of screws 42, 44, 46 and 48, may each be inserted through one of the apertures extending through the lock-down plate and screwed into the mounting surface. Those skilled in the art will appreciate that lock-down plate 12 is more readily fixed to the mounting surface if holes are drilled into the mounting surface in such a way that the holes are aligned with apertures 34, 36, 38 and 40 prior to fixing the lock-down plate to the mounting surface with the fasteners.

In the illustrated embodiment of FIG. 1, each aperture is centered in a recessed well 50. Recessed wells 50 of lock-down plate 12 accommodate the heads of screws 42, 44, 46 and 48 to prevent them from extending above the upper surface of the generally flat lock-down plate when the heads of those screws are screwed flush against the lock-down plate and the threaded portions of those screws extend through the apertures and into the mounting surface. Recessed wells 50 permit security box 14 to be easily received by and removed from lock-down plate 12.

Referring now to security box 14 shown in FIG. 1, the security box includes a generally flat bottom panel 54, a top panel 56 and a plurality of side panels, each of which is identified by reference numeral 58. As shown in FIG. 1, security box 14 is closed and therefore the exterior faces of panels 54, 56 and 58, respectively, are depicted in that Figure.

Bottom panel 54 of security box 14 includes a bolt-passage slot 60 extending therethrough. Bolt-passage slot 60 is adapted to receive a deadbolt such as the deadbolt 62 shown in FIG. 1. Deadbolt 62 is associated with a lock set generally designated by reference numeral 63 (see FIG. 8).

Figure 8:
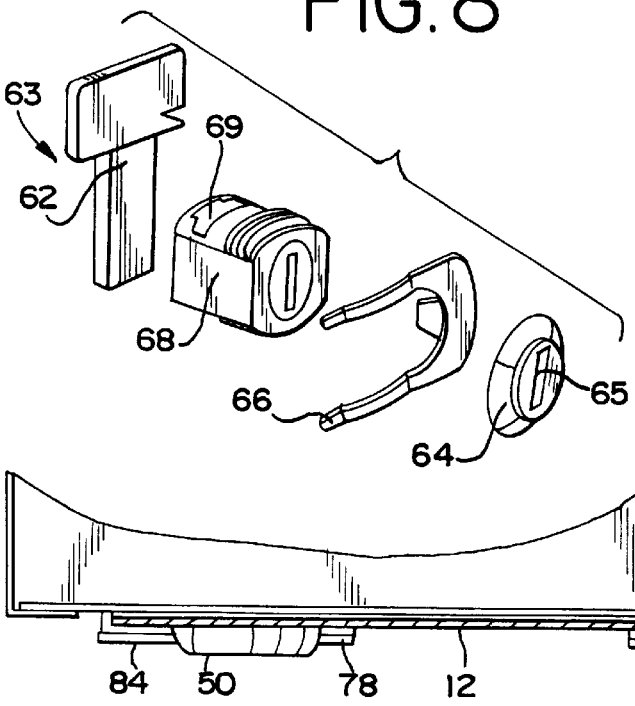
FIG. 8 is an exploded perspective view of the component parts of a lock set which may be used in conjunction with the improved lock-down security box of the present invention.

Referring to FIG. 8, there is shown the component parts of the lock set 63 identified above. Lock set 63 includes a lock activation portion 64 having a key slot 65, a lock-retaining clip 66, a lock 68, and the deadbolt 62 previously identified. It should be understood that, as shown in the Figures, lock activation portion 64 and lock 68 together form an integrated assembly. Furthermore, it should be understood that, in practice, deadbolt 62 is received within slot 69 of lock 68. Therefore, when lock set 63 is actuated, the deadbolt 62 extends from and retracts into lock 68, as desired.

The lock set 63 illustrated in the Figures comprises a key-actuated lock set. It will appreciate, however, that the lock sets activated by alternative means such as, for example, by a combination lock actuation device may be substituted for key-actuated lock set 63 shown in the illustrated embodiment.

Referring to FIG. 1, lock activation portion 64 is shown on one of side panels 58 of the security box 14. Deadbolt 62 and lock activation portion 64 are both elements of lock set 63. Lock set 63 independently enables security box 14 to be detachably anchored to lock-down plate 12 and prevents the withdrawal of the marginal edge portions 16 and 18 of the lock-down plate from the channels defined by the flanges of the brackets, all of which are described below.

As further shown in FIG. 1, security box 14 includes a second anchoring member mounted to the exterior face of bottom panel 54. The second anchoring member is shown, for illustrative purposes only, as comprising a pair of brackets 70 and 71. Bracket 70 includes a mounting flange portion 72 which is mounted to the exterior face of bottom panel 54. Mounting flange portion 72 includes offset flange portions 73 and 74 and a pair of plate-capturing flange portions 75 and 76 extending therefrom which are spaced apart from the exterior face of bottom panel 54 to define a channel with that face. Those skilled in the art will appreciate that a single flange alternatively may be used in place of plate-capturing flange portions 75 and 76 without departing from the scope of the present invention as defined by the appended claims.

As shown in the preferred embodiment, an end flange 77 is further included at the end of the channel defined by flanges 73, and 75 and the exterior face of bottom panel 54. End flange 77 facilitates the registry of bolt-passage slot 60 and bolt-receiving slot 32 when the security box is received on lock-down plate 12. Furthermore, end flange 77 prevents security box 14 from being slid past the point where the marginal edge portion 16 of lock-down plate 12 abuts the end flange.

In similar fashion, bracket 71, which is mounted on the exterior face of bottom panel 54, includes a mounting flange portion 78. As shown, bracket 71 further includes offset flange portions 80 and 82 and plate-capturing flange portions 84 and 86 extending from the mounting flange portion 78. As further shown, plate-capturing flange portions 84 and 86 are spaced apart from the exterior face of bottom panel 54. In this arrangement, flanges 80, 82, 84 and 86 and the exterior face of bottom panel 54 define a channel which accommodates flange portions 26 and 28 of marginal edge portion 18 of lock-down plate 12. In particular, the defined channel allows the marginal edge portion 18 of lock-down plate 12 to be positioned therein when the security box 14 is received on the lock-down plate. An, end flange 87 prevents security box 14 from being slid past the point where the marginal edge portion 18 of lock-down plate 12 abuts the end flange.

In the illustrated embodiment, the exterior face of bottom panel 54 includes an end flange 87 mounted thereon which extends from one end of plate-capturing flange portion 84, thereby defining a closed end for the channel formed by flanges 80 and 84 and the exterior face of bottom panel 54. Again, end flange 87 facilitates the registry of bolt-passage slot 60 with bolt-receiving slot 32 when the security box 14 is received on lock-down plate 12.

Figure 2:
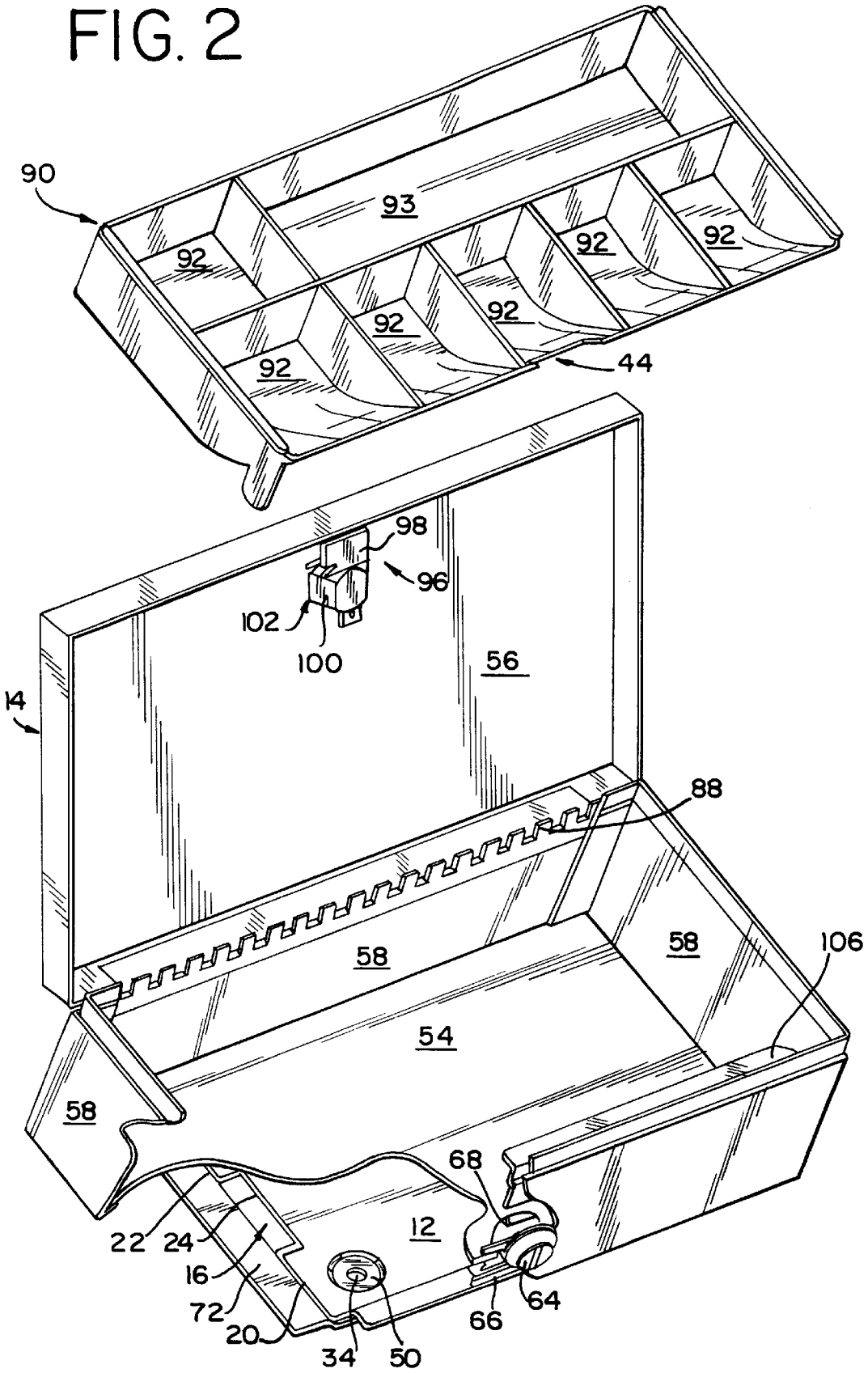
FIG. 2 is a top isometric view of the improved lock-down security box of FIG. 1 shown partially cut-away wherein the security box is in its open configuration.

Referring now to FIG. 2, the lock-down security box 10 is shown in an exploded partially cut-away front isometric view. Security box 14 of the lock-down security box 10 is received on lock-down plate 12. Marginal edge portion 16 of lock-down plate 12 is accommodated within the channel formed by flange portions 72, 73, 74 and 76 of bracket 70 and the exterior face of bottom panel 54. The deadbolt 62 and the lock activation portion 64 of lock set 63 are also shown with the deadbolt being extended through the bolt-passage slot 60 of the security box and the bolt-receiving slot 32 of the lock-down plate.

The security box 14 is received on lock-down plate 12 and the opposed marginal edge portions 16 and 18 of the lock-down plate are positioned in the channels which are defined by brackets 70 and 71 by sliding the exterior face of bottom panel 54 over the upper surface of the lock-down plate. Once the marginal edge portions 16 and 18 of lock-down plate 14 are accommodated within the channels defined by the flange portions of brackets 70 and 71 and the exterior face of bottom panel 54, bolt-receiving slot 32 and bolt-passage slot 60 are in registry with each other to permit deadbolt 62 to extend through bolt-passage slot 60 and into bolt-receiving slot 32. This insertion of the deadbolt 62 through bolt-passage slot 60 and bolt-receiving slot 32, respectively, prevents movement of security box 14 in a first lateral direction, which is parallel to the channels defined by brackets 70 and 71, when lock-down plate 12 is fixed to a mounting surface with a plurality of fasteners such as the screws illustrated in FIG. 1. Furthermore, brackets 70 and 71 prevent movement of security box 14 in a lateral direction transverse to the above-described first lateral direction when the security box is received on lock-down plate 12 and the plate is fixed to a mounting surface. Moreover, the plate-capturing flange portions of brackets 70 and 71 prevent movement of security box 14 in an upward direction when the marginal edge portions 16 and 18 of lock-down plate 12 are accommodated within the channels defined by the flanges of those brackets and the exterior surface of bottom panel 54. As a result, when security box 14 is received on lock-down plate 12 and, further, when the lock-down plate is fixed to a mounting surface, the security box is detachably mounted to that mounting surface.

As further shown in FIG. 2, security box 14 is in its open configuration. In a preferred embodiment of the present invention, such as the embodiment shown in FIG. 2, top panel 56 may be moved between opened and closed positions. As shown, top panel 56 is pivotally mounted to one of the side panels 58 of security box 14. In particular, top panel 56 is hingedly connected to one of those side panels through use of a piano-hinge arrangement 88 which may be constructed in a manner well known in the art.

Also shown in FIG. 2 are the interior faces of the panels of security box 14 which define the boundaries for an enclosure of the security box. A tray, such as the tray 90 shown in FIG. 2, may be included with security box 14 to provide a plurality of coin-retaining compartments 92 and a paper currency-retaining compartment 93. Coins, currency, valuable papers, negotiable instruments and the like may be stored within the enclosure of the security box when that security box is in its closed configuration.

Tray 90 may further include a recessed portion 94 on an edge of the tray so that the tray may accommodate another lock set which is preferably mounted to top panel 56 and generally identified by reference numeral 96. Lock set 96 includes a deadbolt 98, a lock 100, a lock-retaining clip 102 and a lock activation portion 104 (see FIG. 3).

Lock set 96 may be similar to the lock set 63 described earlier with reference to FIG. 8. Lock set 96 is preferably mounted to top panel 56 and is partially contained within the enclosure of security box 14. Lock set 96 is associated with top panel 56 and independently provides controlled access to the enclosure of security box 14. In particular, lock set 96 may be actuated to extend and retract deadbolt 98 as desired.

When security box 14 is in its closed configuration, lock set 96 may be actuated so that deadbolt 98 is extended beyond and below a lip portion 106 of security box 14 to prevent access to the enclosure of the security box. Alternatively, lock set 96 may be actuated so that deadbolt 98 is retracted by lock 100 and top panel 56 is able to pivot at piano-hinge arrangement 88, thereby enabling access to the enclosure of security box 14.

Those skilled in the art will appreciate that lock set 96 may comprise a key-actuated lock set such as the one shown and described in the figures, or, alternatively, lock set 96 may comprise other types of lock sets such as, for example, a combination lock set.

Figure 3:
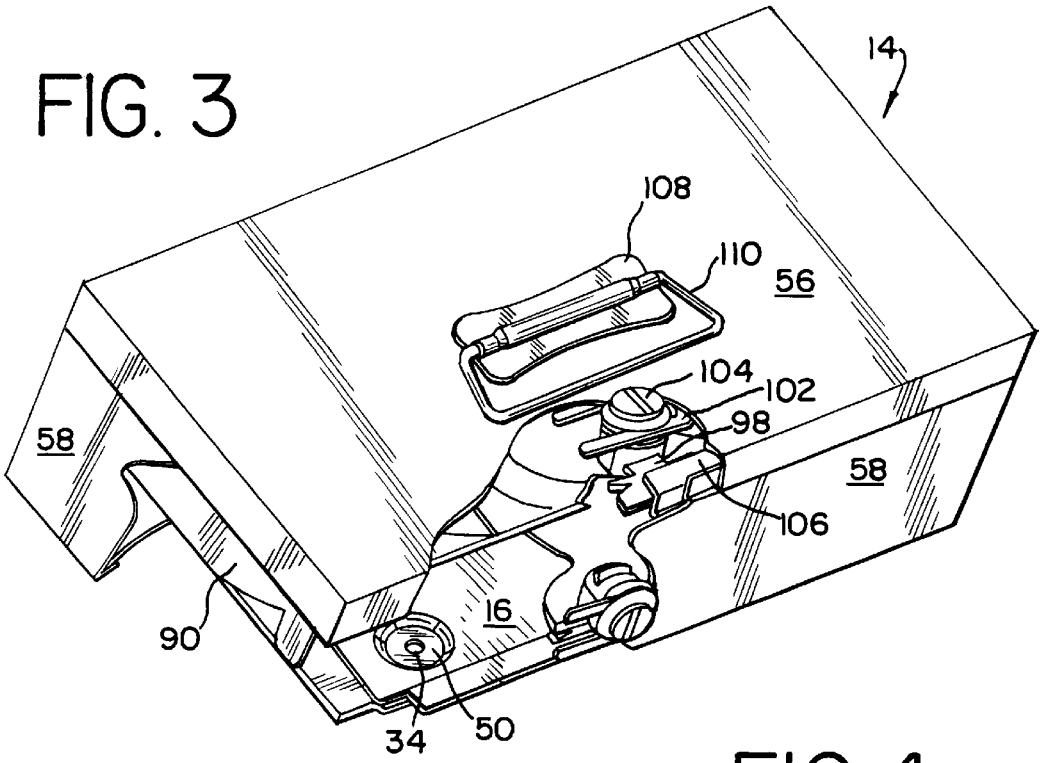
FIG. 3 is a top isometric view of the improved lock-down security box of FIGS. 1 and 2 shown partially cut-away wherein the security box is closed.

Referring now to FIG. 3, the lock-down security box 10 of the present invention is shown in a partially cut-away top isometric view. As shown in FIG. 3, security box 14 is illustrated in its closed configuration and deadbolt 98 of lock set 96 is extended beneath lip portion 106 of the security box so that it will engage that lip portion when the box is locked.

Furthermore, in FIG. 3, security box 14 is received on lock-down plate 12. The deadbolt 62 of lock set 63 is shown extended through bolt-passage slot 60 of the security box and bolt-receiving slot 32 of the lock-down plate to restrain movement of the security box while the box is anchored to the lock-down plate. This further prevents the withdrawal of security box 14 from lock-down plate 12.

Included on top panel 56 of security box 14 is a handle mounting member 108 which mounts a handle member 110 to the top panel of the security box. Handle member 110 enhances the portability of the security box. Thus, the security box may be transported from one location to another, such as from one lock-down plate of the type identified in the Figures by reference numeral 12 to another lock-down plate of that same type, for example.

Figure 4:
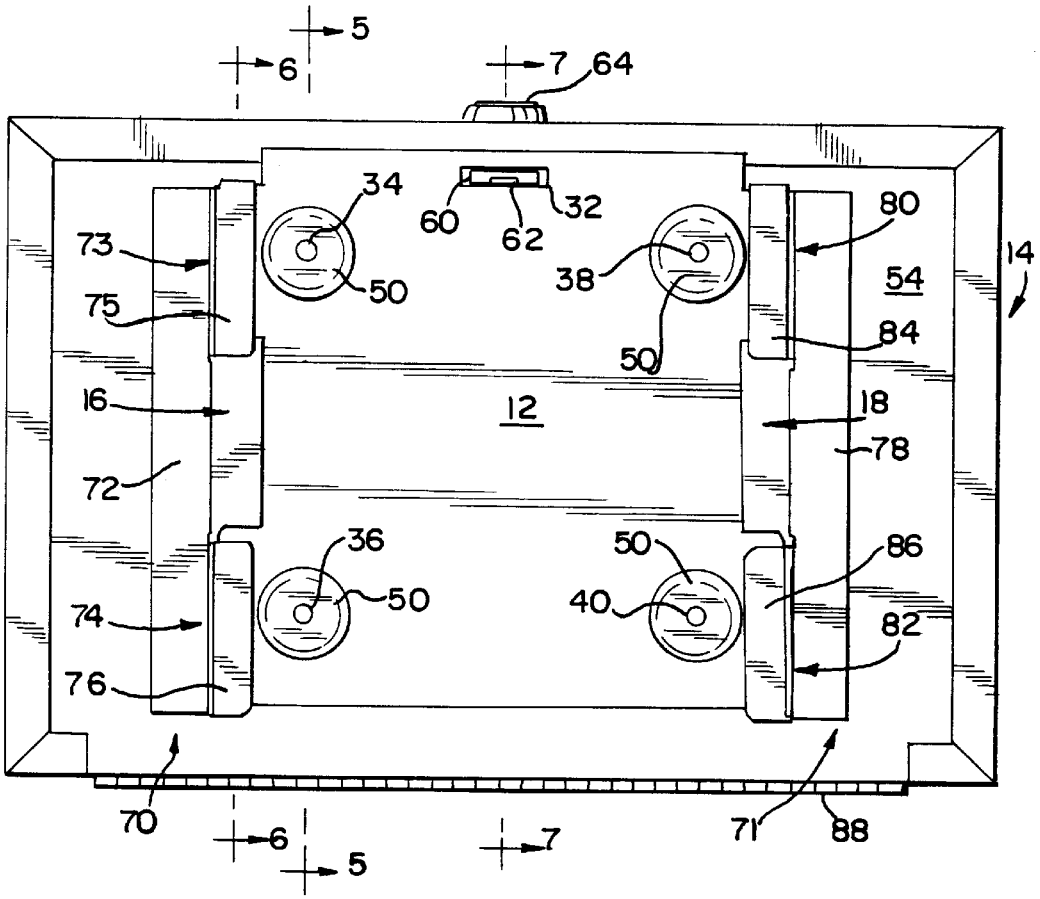
FIG. 4 is a bottom plan view of the improved lock-down security box of FIGS. 1–3.

Referring now to FIG. 4, a bottom plan view of the lock-down security box 10 is shown. The marginal edge portions 16 and 18 of lock-down plate 12 are accommodated within the channels defined by the plate-capturing flange portions and offset flange portions of brackets 70 and 71 and the exterior face of bottom panel 54. The lock-down plate 12 is preferably fixed to a mounted surface through use of a plurality of fasteners that are inserted through apertures of the lock-down plate.

The exterior face of bottom panel 54 of security box 14 is received on the upper surface of the generally flat lock-down plate 12 in a manner wherein the opposed marginal edge portions 16 and 18 of the lock-down plate are positioned within the channels defined by the offset flange portions and plate-capturing flange portions of brackets 70 and 71 and the exterior face of the bottom panel 54. Security box 14 is prevented from being slid past the point where the opposed marginal edge portions 16 and 18 of lock-down plate 12 abut the end flanges 77 and 87 of brackets 70 and 71.

Bolt-passage slot 60 and bolt-receiving slot 32 of the security box 14 and the lock-down plate 12, respectively, are in registration with each other when the lock-down security box 10 is in this configuration. This permits the deadbolt 62 of lock set 63 to extend through slots 60 and 32 so that security box 14 is prevented from being withdrawn from lock-down plate 12. It should be apparent that deadbolt 62 of lock set 63 may also be removed from slots 60 and 32 to enable security box 14 to be withdrawn from lock-down plate 12.

As is further shown in FIG. 4, brackets 70 and 71 prevent the movement of security box 14 in both an upward direction and a lateral direction when the box is received on lock-down plate 12. With respect to their prevention of the upward movement, the plate-capturing flange portions of those brackets engage the marginal edge portions of the lock-down plate to prevent such movement. With respect to their prevention of lateral movement, the offset flange portions of those brackets engage the marginal edge portions of the lock-down plate.

Figure 5:
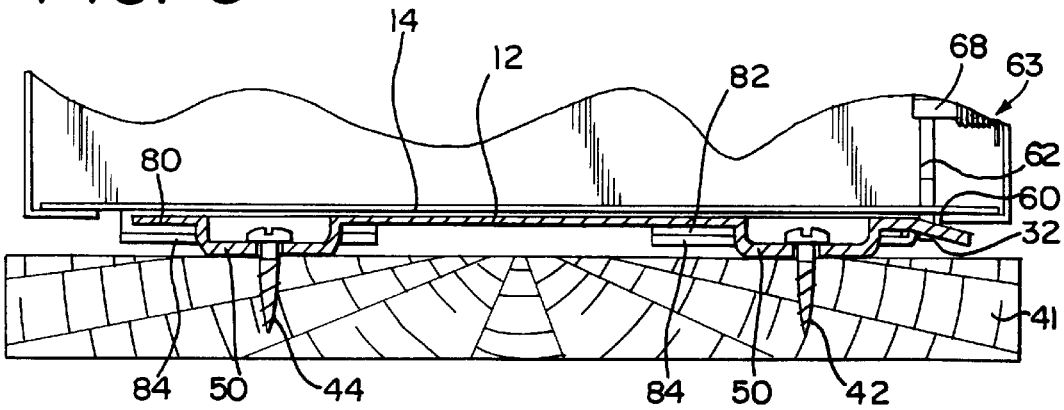
FIG. 5 is a sectional view of the improved lock-down security box of FIGS. 1–4 taken along line 5—5 of FIG. 4.

Referring now to FIG. 5, there is shown a view of the lock-down security box of the present invention taken along the line 5—5, which extends through the apertures of the lock-down plate as shown in the bottom plan view of FIG. 4. Accordingly, FIG. 5 shows two fasteners, namely screws 42 and 44, which are inserted through apertures 34 and 38 of lock-down plate 12 to fix that plate to the mounting surface 41. As earlier noted, the present invention may be practiced by using any type of fastener well known in the art. The deadbolt 62 of lock set 63 is shown extending through both bolt-passage slot 60 and bolt-receiving slot 32.

Figure 6:
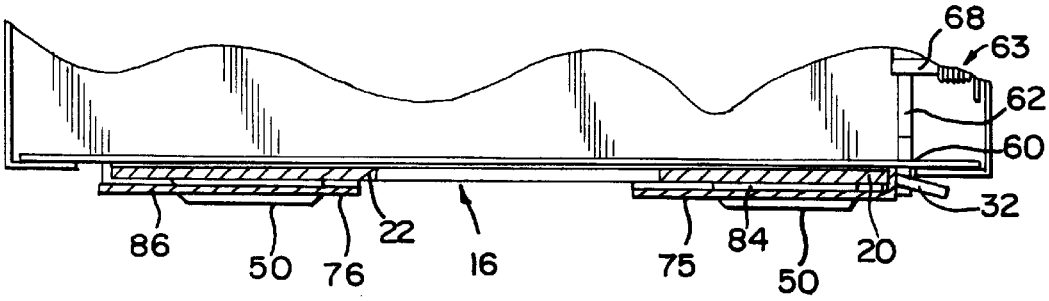
FIG. 6 is a sectional view of the improved lock-down security box of FIGS. 1–4 taken along line 6—6 of FIG. 4.

Referring now to FIG. 6, the lock-down security box 10 of the present invention is shown in a sectional view taken along line 6—6 of the bottom plan view of FIG. 4. In FIG. 6, the cross-section of the lock-down security box is taken along a pair of the plate-capturing flange porions mounted on the exterior face of the bottom panel of the security box. Again, this Figure is depicted to show the manner in which the security box is received on the lock-down plate 12 when the lock-down security box 10 is mounted to mounting surface 41.

In this position, marginal edge portion 16 of lock-down plate 12 is accommodated within the channel defined by the plate-capturing flange portions of bracket 70, the offset flange portion of that same bracket and the exterior face of bottom panel 54. When the marginal edge portions 16 and 18 of lock-down plate 12 abut the end flanges 77 and 87 of brackets 70 and 71, as shown, the bolt-passage slot 60 of the security box and the bolt-receiving slot 32 of the lock-down plate 12 are in registration with each other to permit extension of deadbolt 62 of lock set 63 through those slots. When deadbolt 62 is thus extended, the security box 14 is prevented from moving in a first lateral direction. Furthermore, the plate-capturing flange portions of the anchoring member for the security box and the marginal edge portions of the anchoring member for the lock-down plate prevent movement of the security box in an upwardly direction from the lock-down plate when the security box is received on that plate. These flange portions further restrict movement in a second lateral direction which is transverse to the first lateral direction defined above. As a result, the security box 14 is prevented from being withdrawn from lock-down plate 12 when the security box is received on the lock-down plate and the lock set 63 is actuated to extend deadbolt 62 through slots 60 and 32.

Figure 7:
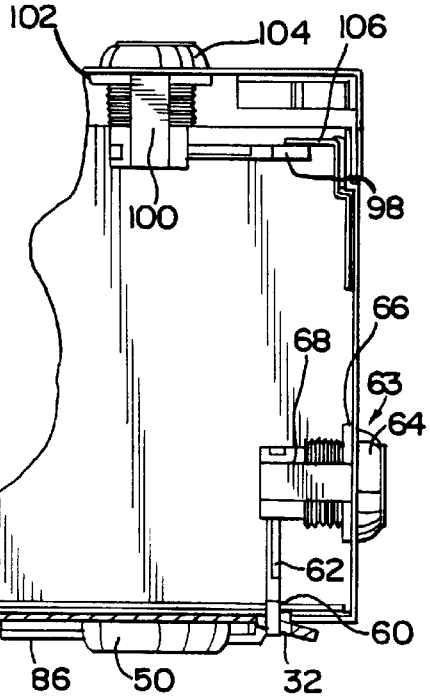
FIG. 7 is a sectional view of the improved lock-down security box of FIGS. 1–4 taken along line 7—7 of FIG. 4.

Referring now to FIG. 7, there is shown a sectional view of the lock-down security box 10 of the present invention taken along lines 7—7 of the bottom plan view of FIG. 4. In particular, FIG. 7 is a sectional view taken along both lock sets 63 and 96 of security box 14. As shown, the lock sets are both in a position wherein their respective deadbolts 62 and 98 are extended. With respect to lock set 63, the deadbolt 62 is extended through both bolt-passage slot 60 of the security box and bolt-receiving slot 32 of the lock-down plate 12. This extension of deadbolt 62 through those slots prevents withdrawal of the security box 14 from lock-down plate 12 when the marginal edge portions of the lock-down plate are accommodated within the channels defined by the flanges of brackets 70 and 71.

With respect to lock set 96, the extended deadbolt 98 is shown in a position immediately below lip portion 106 of security box 14. Thus, should someone try to open the security box by pivoting top panel 56 at piano-hinge arrangement 88 (see FIG. 2), the deadbolt 98 will engage lip portion 106 and prevent access to the enclosure of the security box. Therefore, lock set 96 provides controlled access to the enclosure of the security box.

Although the present invention has been described with reference to a certain preferred embodiment, modification or changes may be made therein by those skilled in the art without departing from the scope and spirit of the invention as defined by the appended claims.

I claim:

1. A lock-down security box adapted to be detachably anchored to a mounting surface comprising, in combination:

a lock-down plate, said lock-down plate including:

a first anchoring member, said first anchoring member comprising a pair of opposed marginal edge portions, a bolt-receiving slot extending through said lock-down plate, said bolt-receiving slot being adapted to receive a deadbolt; and a security box, said security box including:

a bottom panel, a top panel and at least one side panel connecting said bottom panel with said top panel, each of said panels having an interior and an exterior face, the interior faces of said panels defining boundaries for an enclosure of said security box wherein items may be stored, at least one of said panels providing selective access to said enclosure, one of said panels having a bolt-passage slot extending therethrough, a second anchoring member mounted to the exterior face of one of said panels, said second anchoring member comprising a pair of brackets each of which defines a channel for receiving one of said opposed marginal edge portions of said first anchoring member, a first lock set mounted to one of said panels including a lock activation portion on the exterior face of the panel to which said first lock set is mounted, said first lock set being operatively associated with said at least one of said panels to independently provide controlled access to said enclosure, and a second lock set mounted to one of said panels independently enabling said security box to be detachably anchored to said lock-down plate when the exterior face of one of said panels is received on said lock-down plate and said opposed marginal edge portions of said lock-down plate are positioned in said channels.

2. The lock-down security box of claim 1, wherein said lock-down plate comprises a bolt-receiving slot extending therethrough, said second lock set comprises a deadbolt portion, and said bolt-receiving slot is adapted to accommodate said deadbolt portion of said second lock set.

3. The lock-down security box of claim 2 wherein one of said plurality of panels includes a bolt-passage slot extending therethrough, said bolt-passage slot being adapted to accommodate said deadbolt portion of said second lock set.

4. The lock-down security box of claim 1, wherein said lock-down plate comprises at least one aperture extending therethrough, said at least one aperture enabling said lock-down plate to be fixed to said mounting surface when a fastener is inserted through said aperture.

5. The lock-down security box of claim 1, wherein at least one of said panels is movable between open and closed positions and comprises a pivotally mounted panel.

6. The lock-down security box of claim 1, wherein said second anchoring member comprises a pair of brackets, each of said brackets including flange portions which define a channel for receiving said first anchoring member.

7. The lock-down security box of claim 6, wherein each of said channels has an open end and at least one of said channels has a closed end.

8. The lock-down security box of claim 3, wherein both channels have an open end and a closed end.

9. A lock-down security box adapted to be detachably anchored to a mounting surface comprising, in combination:

a lock-down plate, said lock-down plate including:

a first anchoring member, said first anchoring member comprising a pair of opposed marginal edge portions, a bolt-receiving slot extending through said lock-down plate, said bolt-receiving slot being adapted to receive a deadbolt, and at least one aperture extending through said lock-down plate enabling said lock-down plate to be fixed to said mounting surface when a fastener is inserted through said aperture; and a security box, said security box including:

a bottom panel, a top panel and at least one side panel connecting said bottom panel with said top panel, each of said panels having an interior and an exterior face, the interior faces of said panels defining boundaries for an enclosure of said security box wherein items may be stored, at least one of said panels comprising a pivotally mounted panel for providing selective access to said enclosure, one of said panels having a bolt-passage slot extending therethrough, a second anchoring member mounted to the exterior face of one of said panels, said second anchoring member comprising a pair of brackets, each of said pair of brackets having flange portions which define a channel for receiving one of said pair of opposed marginal edge portions of said first anchoring member, each of said channels having an open end and at least one of said channels having a closed end, a first lock set mounted to one of said panels and at least partially contained within said enclosure, said first lock set including a lock activation portion on the exterior face of the panel to which said first lock set is mounted, said first lock set being operatively associated with said pivotally mounted panel to independently provide controlled access to said enclosure, and a second lock set mounted to one of said panels and at least partially contained within said enclosure, said second lock set comprising a deadbolt portion, said second lock set independently enabling said security box to be detachably anchored to said lock-down plate when the exterior face of the panel through which said bolt-passage slot extends is received on said lock-down plate and said opposed marginal edge portions of said lock-down plate are positioned in said channels so that said bolt-passage slot of the panel through which it extends and said bolt-receiving slot of said lock-down plate are in registration with each other to enable the deadbolt portion of said second lock set to extend through the bolt-passage slot of said security box and into the bolt-receiving slot of said lock-down plate.

10. The lock-down security box of claim 9, wherein said second lock set includes a lock activation portion on the exterior face of the panel to which said second lock set is mounted.

11. The lock-down security box of claim 9, wherein said lock-down plate comprises a generally flat lock-down plate.

12. The lock-down security box of claim 11, wherein said bottom panel of said security box comprises a generally flat bottom panel.

13. The lock-down security box of claim 8, wherein said second anchoring member is mounted to the exterior face of said bottom panel.

14. The lock-down security box of claim 9, wherein said first lock set comprises a deadbolt portion.

15. The lock-down security box of claim 9, wherein both channels have a closed end.

16. The lock-down security box of claim 9, wherein each of said brackets comprises a mounting flange portion, a plate-capturing flange portion and an offset flange portion connecting said mounting flange portion with said plate-capturing flange portion so that said plate-capturing flange portion is spaced apart from the exterior face of said bottom panel.

17. The lock-down security box of claim 16, wherein each of said brackets further comprises an additional plate-capturing flange portion and an additional offset flange portion connecting said mounting flange portion with said additional plate-capturing flange portion so that said additional plate-capturing flange portion is spaced apart from the exterior face of said bottom panel.

18. A lock-down security box adapted to be detachably anchored to a mounting surface comprising, in combination:

a generally flat lock-down plate, said lock-down plate including:

a first anchoring member, said first anchoring member comprising a pair of opposed marginal edge portions, a bolt-receiving slot extending through said lock-down plate, said bolt-receiving slot being adapted to receive a deadbolt, and at least one aperture extending through said lock-down plate enabling said lock-down plate to be fixed to said mounting surface when a fastener is inserted through said aperture; and a security box, said security box including:

a generally flat bottom panel, a top panel and at least one side panel connecting said bottom panel with said top panel, each of said panels having an interior and an exterior face, the interior faces of said panels defining boundaries for an enclosure of said security box wherein items may be stored, said top panel comprising a pivotally mounted panel for providing selective access to said enclosure, said bottom panel having a bolt-passage slot extending therethrough, a second anchoring member mounted to the exterior face of said bottom panel, said second anchoring member comprising a pair of brackets, each of said pair of said brackets comprising a mounting flange portion, a plate-capturing flange portion and an offset flange portion that connects said mounting flange portion with said plate-capturing flange portion so that said plate-capturing flange portion is spaced apart from the exterior face of said bottom panel, each of said pair of brackets further defining a channel for receiving one of said pair of opposed marginal edge portions of said first anchoring member, each of said channels having an open end and a closed end, a first lock set mounted to said top panel and at least partially contained within said enclosure, said first lock set including a lock activation portion on the exterior face of said top panel, said first lock set comprising a deadbolt portion, said first lock set being operatively associated with said top panel to independently provide controlled access to said enclosure, and a second lock set mounted to one of said panels and at least partially contained within said enclosure, said second lock set including a lock activation portion on the exterior face of the panel to which said second lock set is mounted, said second lock set comprising a deadbolt portion, said second lock set independently enabling said security box to be detachably anchored to said lock-down plate when the exterior face of the panel through which said bolt-passage slot extends is received on said lock-down plate and said opposed marginal edge portions of said lock-down plate are positioned in said channels so that said bolt-passage slot of the panel through which it extends and said bolt-receiving slot of said lock-down plate are in registration with each other to enable the deadbolt portion of said second lock set to extend through the bolt-passage slot of said security box and into the bolt-receiving slot of said lock-down plate.

* * * * *